US005277046A

United States Patent [19]

Paybarah et al.

[11] Patent Number: 5,277,046

[45] Date of Patent: Jan. 11, 1994

[54] COIL WINDING METHOD AND APPARATUS FOR DAMPENING VIBRATIONS

[75] Inventors: Ali Paybarah; Joseph A. McWilliams, both of Droitwich, United Kingdom

[73] Assignee: Zortech International Limited, Droitwich, United Kingdom

[21] Appl. No.: 968,207

[22] Filed: Oct. 29, 1992

[30] Foreign Application Priority Data

Nov. 2, 1991 [GB] United Kingdom ..... 9123297

[51] Int. Cl.[5] ..... B21F 3/04

[52] U.S. Cl. ..... 72/142; 72/428

[58] Field of Search ..... 72/142, 135, 428, 43, 72/342.2

[56] References Cited

U.S. PATENT DOCUMENTS

| | | | |
|---|---|---|---|
| 2,142,865 | 1/1939 | Zabel | 72/135 |
| 2,450,324 | 9/1948 | Wilson et al. | 72/142 |
| 2,651,104 | 9/1953 | Giros | 72/135 |
| 3,368,377 | 2/1968 | Hirayama et al. | 72/135 |
| 3,779,846 | 12/1973 | Kleykamp et al. | 72/135 |

FOREIGN PATENT DOCUMENTS

| | | | |
|---|---|---|---|
| 126328 | 12/1947 | Australia | 72/142 |
| 1602623 | 12/1969 | Fed. Rep. of Germany . | |
| 2056336 | 3/1981 | United Kingdom . | |

*Primary Examiner*—Lowell A. Larson
*Assistant Examiner*—Michael J. McKeon
*Attorney, Agent, or Firm*—Ira S. Dorman

[57] ABSTRACT

Vibrations that arise during the winding of a coil of wire onto a rotating mandrel are damped by surrounding the coil with a tube such that the tube is spaced from the coil and by supplying fluid to the tube. The tube extends in the axial direction of the coil along at least a part of its length and, due to the spacing between the tube and the coil, conducts fluid such as water in a confined manner towards at least one end of the tube and releases the fluid from the end of the tube, for example in a region of the coil adjacent to and/or remote from the winding of the coil.

37 Claims, 2 Drawing Sheets

COIL WINDING METHOD AND APPARATUS FOR DAMPENING VIBRATIONS

The present invention relates to a method and apparatus for use in damping vibrations during the winding of a coil.

BACKGROUND OF THE INVENTION

When winding a coil of-wire on a rotating stub mandrel, irregularities in the winding mechanism and in the wire give rise to vibrations and in excursions of the wound coil from its axis of rotation. Vibration can also arise from other sources, such as a mechanism for periodically cutting the coil into predetermined lengths. It is known to damp such vibrations by applying pads or rollers to the rotating coil, but such damping means can damage the wire and is a source of friction. The severity of these vibrations increases with increasing rotational speed of the mandrel and of the coil and effectively limits the rotational speed of the mandrel to some 2,000 to 4,000 r.p.m. These vibrations can give rise to unevenly wound coils and deformed portions of coil where it is cut into desired lengths. Any method of effectively dampening such vibrations would contribute to higher productivity and lower manufacturing costs.

OBJECT OF THE INVENTION

It is an object of the present invention to provide a method and apparatus for damping vibrations during the winding of a coil so as to facilitate higher productivity and/or improved product quality. It is a further object of the present invention to provide a method and apparatus for damping vibrations during the winding of a coil so as to reduce the manufacturing costs of such coils.

SUMMARY OF THE INVENTION

According to one aspect of the present invention there is provided a method for damping vibrations during the winding of a coil, comprising the steps of:

supplying a fluid at a position along the length of the coil;

conducting the fluid in a confined manner from said position in the axial direction of the coil; and subsequently releasing the fluid from its confined flow path.

The fluid may be released from its confined flow path in a region of the coil adjacent the winding thereof. Alternatively or additionally, the fluid may be released from its confined flow path in the region of the coil remote from the winding thereof.

The fluid may comprise water.

The fluid may be confined within a tube which surrounds the coil.

The mandrel may rotate at speeds up to at least 10,000 r.p.m.

The method may include the steps of:

supplying a fluid in a confined manner around the coil as it advances beyond a cutting station;

cutting the wound coil into predetermined lengths as the coil advances; and releasing the cut wound coil from the confined fluid.

According to another aspect of the present invention there is provided apparatus for use in damping vibrations during the winding of a coil onto a rotating mandrel comprising tube means for surrounding the coil in a spaced manner, and means for supplying fluid to the tube means, the tube means extending in the axial direction of the coil along at least a part of the length thereof and being dimensioned so as to be spaced around the coil for conducting fluid in a confined manner therealong towards at least one end of the tube means and for releasing the fluid from said end of the tube means.

The tube means may be arranged such that said at least one end of the tube means is located adjacent to a region in which the coil is to be wound.

The tube means may extend in the axial direction of the coil in such a manner as to conduct fluid in a confined manner therealong towards both ends of the tube means and to release the fluid from both ends of the tube means.

The supply means may be positioned substantially midway between the ends of the tube means.

The tube means may be made of a plastics material.

The tube means may made of a transparent or translucent material.

The apparatus may include a cutting station for cutting the wound coil into predetermined lengths as it advances, means for supplying a fluid to an openable receiving device that extends around the coil as it advances beyond the cutting station, and means for opening the receiving device so as to release the cut wound coil therefrom.

For a better understanding of the present invention and to show more clearly how it may be carried into effect reference will now be made, by way of example, to the accompanying drawings in which:

DESCRIPTION OF PREFERRED EMBODIMENTS

Figure 1:
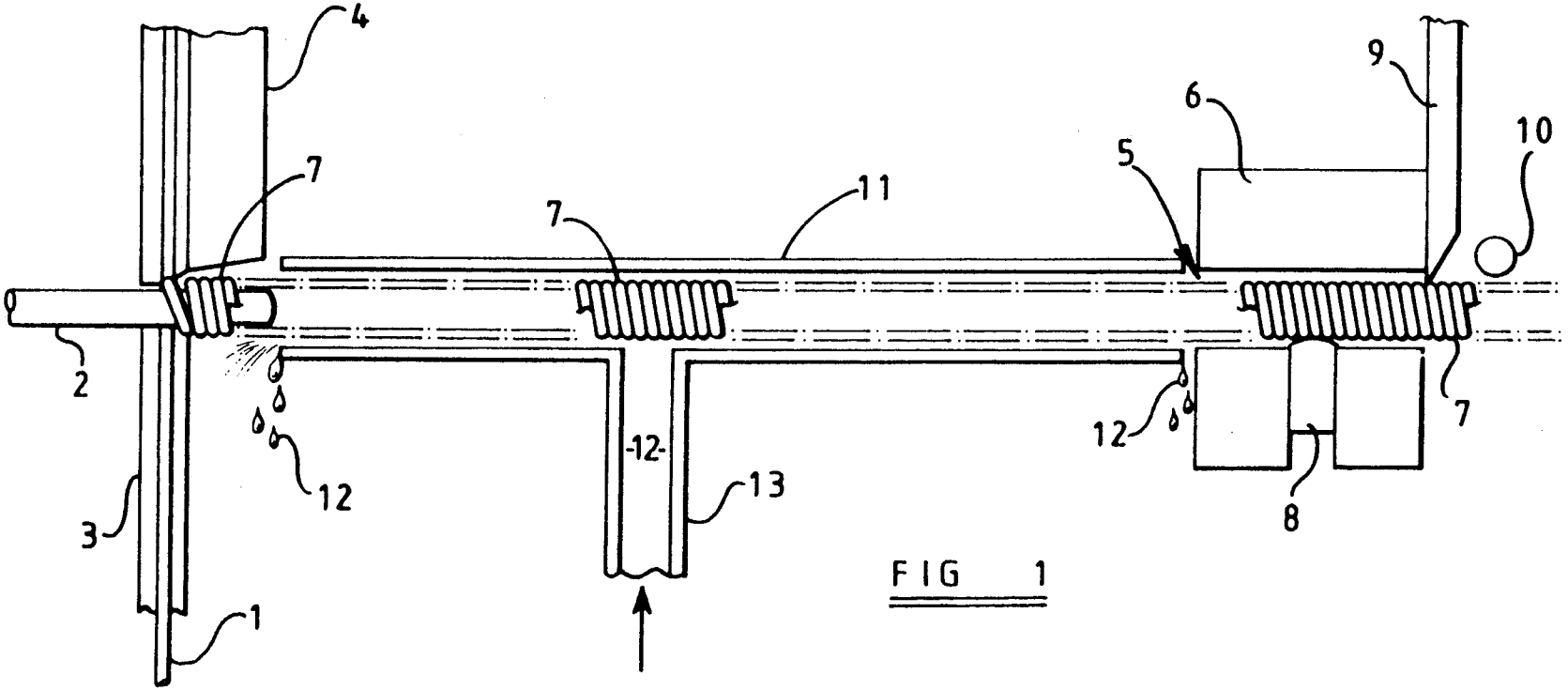
FIG. 1 is a diagrammatic elevational illustration of one embodiment of an apparatus according to the present invention for winding a helical coil.

FIG. 1 shows part of an apparatus for winding helical coils which may have external diameters of 5 to 7 mm for example. Wire 1 is fed onto one end of a rotating mandrel 2 by way of a guide wheel 3 and is urged against the mandrel by a pressure wheel 4. The length of the mandrel is such that is does not extend substantially beyond the pressure wheel 4. The coil 7 extends beyond the mandrel 2 and passes through an aperture 5 in a coil retaining block 6 which forms part of a cutting station. Also provided within the coil retaining block 6 is a coil lifting pin 8 which operates intermittently in co-operation with a cutting blade 9 to cut the coil into the desired lengths. The coil lifting pin 8 operates by means (not shown) well known to the skilled person to urge the coil 7 intermittently against the upper surface to the aperture 5 in the coil retaining block 6, while the cutting blade 9 descends and cuts the wire forming the coil so as to produce the desired length of coil. A roller 10 serves to restrain movement of the cutting blade 9 in the axial direction of the coil.

That part of the coil 7 extending between the pressure wheel 4 and the coil retaining block 6 is surrounded at a distance by a tube 11 for a fluid 12 such as water which acts not only as a vibration damping medium, but also as a lubricant and as a coolant. The tube may be made of any suitable material such as metal, plastics or ceramics. A transparent or translucent material may have an advantage in some applications in that the flow of fluid can be monitored. The fluid 12 is supplied to the tube 11 by way of an inlet tube 13 at a flow rate of, for example, 0.5 to 3 liter/minute for a coil having an external diameter of 6 mm and a tube having an internal diameter of 10 mm. A higher flow rate is desirable for smaller diameter coils.

The tube 11 extends substantially up to the pressure wheel 4 and to the coil retaining block 6 with excess fluid flowing out of the ends of the tube. We have found that such an arrangement not only substantially eliminates any vibrations in the coil, but because the fluid is conducted along the coil rather than applied to one end provides a particularly effective mechanism for cooling and lubricating the coil. The effect of this arrangement is to permit the rotational speed of the mandrel to be increased significantly above the present maximum of 4,000 r.p.m. or so. We have successfully and consistently produced high quality coils at speeds of up to 10,000 r.p.m. and more. The fluid not only dampens vibrations in the coils, but also provides the necessary cooling, so even coils are produced at these increased speeds.

Figure 2:
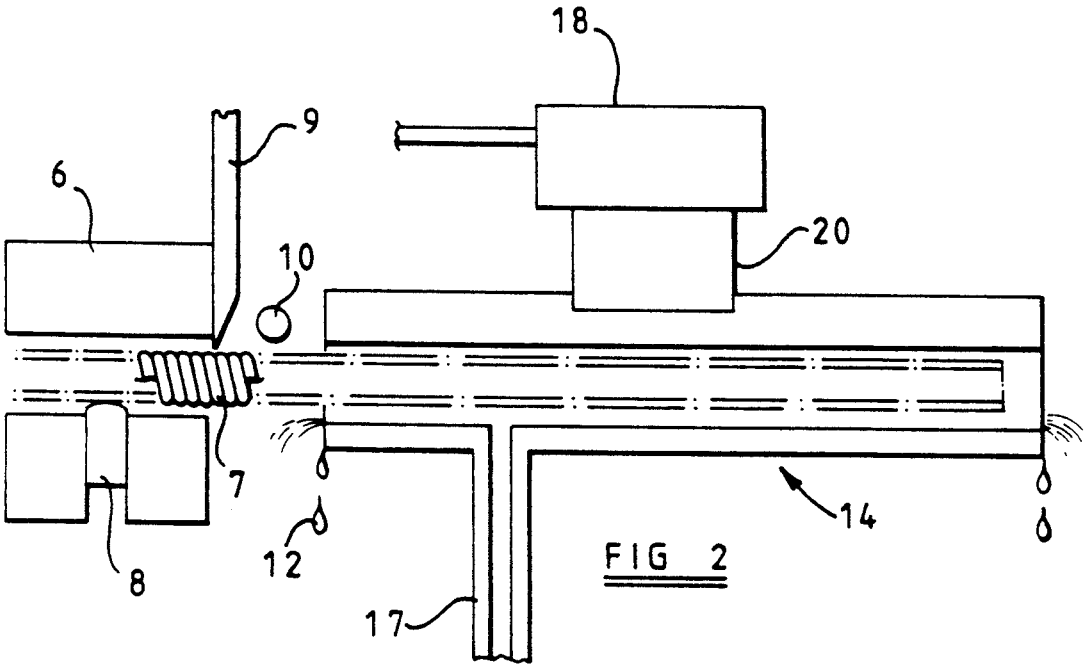
FIG. 2 is a diagrammatic elevational illustration of a modification of the apparatus shown in FIG. 1.
Figure 3:
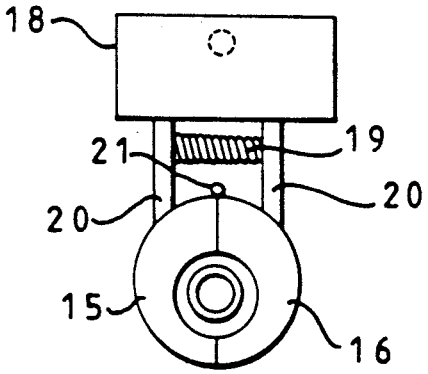
FIG. 3 is an end elevational view of the modified apparatus shown in FIG. 2.

FIGS. 2 and 3 show an apparatus that is a modification of the apparatus of FIG. I and the same reference numerals are used to denote the same or similar parts. The apparatus of FIGS. 2 and 3 is provided with a receiving device 14 for the wound coils. The receiving device comprises two generally semi-cylindrical members 15, 16 which are hinged together along their upper edges by means of a hinge 21 and are biased by spring 19 acting on arms 20 so as to open the receiving device in order that a wound coil may fall out. The semi-cylindrical members 15, 16 may be made of or lined with a plastics material, for example polytetrafluoroethylene. During use of the apparatus, the semi-cylindrical members 15, 16 are operated by means of a pneumatic cylinder 18 and are urged together so as to form a cylindrical space for receiving the wound coil. After each coil has been wound and has advanced a predetermined distance into the cylindrical space, the coil is cut by the cutting blade 9 and the pneumatic cylinder is actuated so as to move the arms 20 towards each other and to open the members 15, 16 thus permitting the wound coil to fall out of the receiving device. An inlet tube 17 is provided to supply fluid within the cylinder formed by the members 15, 16 so as to damp vibrations in the wound coil as it advances into the cylindrical space.

It is usual to cool and to lubricate the coil by feeding a stream of oil onto the wire forming the coil in the region where the wire engages with the mandrel. The use of oil in this manner has a number of disadvantages. First, as the rotational speed of the mandrel increases for increasing productivity, centrifugal forces act on the oil and spray the oil away from the wire and the mandrel, thus leading to insufficient lubrication and effectively limiting the rotational speed of the mandrel to about 4,000 r.p.m. Surprisingly, we have found, in addition to the vibration damping effect of the fluid, that it is not necessary to use oil as the fluid and that ordinary water can be used in its place. This has the added advantage that it is no longer necessary to clean the oil from the cut lengths of coil in a degreasing operation and reduces manufacturing costs substantially. The use of water rather than oil also leads to a more pleasant working environment and, since it is not flammable, to a safer working environment.

We claim:

1. A method of damping vibrations in a coil wound around a rotating mandrel, comprising the steps of:

providing a mandrel which is rotating about an axis;

winding a wire around the rotating mandrel so as to form a rotating coil wound therearound and extending in the direction of the axis of rotation of the mandrel, the wound coil having a first end, disposed at a location at which the wire is initially wound around the rotating mandrel, and having a second end spaced from the first end;

providing at least one enclosure defining an elongate flow path extending in the direction of the axis of mandrel rotation;

advancing the rotating coil from the mandrel through the enclosure along the flow path;

supplying a damping flow to the enclosure at a position intermediate the first and second ends of the coil; and conducting the fluid along the flow path in contact with the coil, and thereafter causing the fluid to exit the enclosure.

2. A method according to claim 1, wherein the fluid exits the enclosure in the region of the first end of the coil.

3. A method according to claim 1, wherein the fluid exits the enclosure in a region of the coil remote from the first end.

4. A method according to claim 1, wherein the fluid exits the enclosure in a region of the first end of the coil as well as in a region of the coil remote from the first end.

5. A method according to claim 1, wherein the fluid comprises water.

6. A method according to claim 1, wherein the enclosure comprises a tube.

7. A method according to claim 1, wherein the mandrel rotates at speeds as high as 10,000 r.p.m.

8. A method according to claim 1 and including the further steps of:

cutting the wound coil into axial sections of predetermined length as the coil advances from the enclosure;

providing a second said enclosure beyond the location at which the coil is cut;

axially advancing the cut sections of coil sequentially from the location of cutting into the second enclosure along the flow path thereof;

introducing a damping fluid into the second enclosure in contact with the coil section advancing thereinto; and removing each coil section from the enclosure.

9. Apparatus for damping vibrations in a coil wound around a rotating mandrel, in which a mandrel is rotating about an axis and a wire is wound around the rotating mandrel so as to form a rotating coil wound thereon and advancing along a path extending in the direction of the axis of rotation of the mandrel, wherein the improvement comprises:

elongate tube means for encompassing the coil and being dimensioned so as to be spaced around the coil, the tube means defining a confined, elongate flow path extending in the direction of the axis of rotation of the mandrel and along at least a part of the path of advancement of the coil, the tube means having an inlet and at least one outlet for fluid mutually spaced along the tube means and in fluid flow communication with one another through the flow path; and means for supplying damping fluid to the fluid inlet of the tube means, whereby the fluid can pass along the confined flow path and exit through the fluid outlet of the tube means.

10. Apparatus as claimed in claim 9, wherein the tube means is arranged such that the one outlet of the tube means is located in the region of initial winding of the wire on the mandrel.

11. Apparatus as claimed in claim 9, wherein the tube means has two opposite ends adjacent to each of which a fluid outlet is provided, whereby fluid can pass from the fluid inlet of the tube means along the confined flow path toward the opposite ends, and can exit the tube means through both outlets.

12. Apparatus according to claim 9, wherein the fluid inlet is positioned substantially between the opposite ends of the tube means.

13. Apparatus as claimed in claim 9, wherein the tube means is made of a plastics material.

14. Apparatus as claimed in claim 9, wherein the tube means is made of a material selected from the group consisting of transparent and translucent materials.

15. Apparatus as claimed in claim 9, further including a cutting station for cutting the wound coil into axial sections of predetermined length as the wound coil advances from the enclosure; a receiving device for receiving sequentially the cut sections of coil as the coil advances axially beyond the cutting station, said receiving device being dimensioned to encompass and to be spaced around the coil sections, and being so constructed as to open and thereby release the coil sections therefrom; means for supplying fluid to the receiving device; and means for effecting opening of the receiving device.

16. A method of damping vibrations in a coil wound around a rotating mandrel, comprising the steps of:

providing a mandrel which is rotating about an axis;

winding a wire around the rotating mandrel so as to form a rotating coil wound therearound and extending in the direction of the axis of rotation of the mandrel, the wound coil having a first end, disposed at a location at which the wire is initially wound around the rotating mandrel, and having a second end spaced from the first end;

providing at least one enclosure defining an elongate flow path extending in the direction of the axis of mandrel rotation;

advancing the rotating coil from the mandrel through the enclosure along the flow path;

supplying a damping fluid to the enclosure at a position intermediate the first and second ends of the coil, with first and second flow path portions extending in opposing axial directions from the intermediate position; and conducting the fluid along the first and second flow path portions in contact with the coil, and thereafter causing the fluid to exit the enclosure from both flow path portions.

17. A method according to claim 16, wherein the fluid comprises water.

18. A method according to claim 16, wherein the enclosure comprises a tube.

19. A method according to claim 16, wherein the mandrel rotates at speeds as high as 10,000 r.p.m.

20. A method according to claim 16, and including the further steps of:

cutting the wound coil into axial sections of predetermined length as the coil advances from the enclosure;

providing a second said enclosure beyond the location at which the coil is cut;

axially advancing the cut sections of coil sequentially from the location of cutting into the second enclosure along the flow path thereof;

introducing a damping fluid into the second enclosure in contact with the coil section advancing thereinto; and removing each coil section from the enclosure.

21. A method of damping vibrations in a coil wound around a rotating mandrel, comprising the steps of:

providing a mandrel which is rotating about an axis;

winding a wire around the rotating mandrel so as to form a rotating coil wound therearound and extending in the direction of the axis of rotation of the mandrel, the wound coil having a first end, disposed at a location at which the wire is initially wound around the rotating mandrel, and having a second end spaced from the first end;

providing at least one enclosure defining an elongate flow path extending in the direction of the axis of mandrel rotation;

advancing the rotating coil from the mandrel through the enclosure along the flow path;

supplying a damping fluid to the enclosure at a position intermediate the first and second ends of the coil;

conducting the fluid along the flow path in contact with the coil, and thereafter causing the fluid to exit the enclosure;

cutting the wound coil into axial sections of predetermined length as the coil advances from the enclosure;

providing a second said enclosure beyond the location at which the coil is cut;

axially advancing the cut sections of coil sequentially from the location of cutting into the second enclosure along the flow path thereof;

introducing a damping fluid into the second enclosure in contact with the coil section advancing thereinto; and removing each coil section from the enclosure.

22. A method according to claim 21 wherein the fluid exits the enclosure in the region of the first end of the coil.

23. A method according to claim 21 wherein the fluid exits the enclosure in a region of the coil remote from the first end.

24. A method according to claim 21, wherein the fluid comprises water.

25. A method according to claim 21, wherein the first-mentioned enclosure comprises a tube.

26. A method according to claim 21, wherein the mandrel rotates at speeds as high as 10,000 r.p.m.

27. Apparatus for damping vibrations in a coil wound around a rotating mandrel, in which a mandrel is rotating about an axis and a wire is wound around the rotating mandrel so as to form a rotating coil wound thereon and advancing along a path extending in the direction of the axis of rotation of the mandrel, wherein the improvement comprises:

elongate tube means for encompassing the coil and being dimensioned so as to be spaced around the coil, the tube means defining a confined, elongate flow path extending in the direction of the axis of rotation of the mandrel and along at least a part of the path of advancement of the coil, the tube means having an inlet and first and second outlets for fluid spaced along the tube means and in fluid flow communication with one another through the flow path, said tube means having two opposite ends adjacent to each of which one of the fluid outlets is disposed, the inlet being disposed therebetween; and means for supplying damping fluid to the fluid inlet of the tube means, whereby the fluid can pass along the confined flow path and exit through both of the fluid outlets.

28. Apparatus according to claim 27, wherein the fluid inlet is positioned substantially between the opposite ends of the tube means.

29. Apparatus according to claim 27, wherein the tube means is made of a plastic material.

30. Apparatus according to claim 27, wherein the tube means is made of a material selected from the group consisting of transparent and translucent materials.

31. Apparatus according to claim 27, further including a cutting station for cutting the wound coil into axial sections of predetermined length as the wound coil advances; a receiving device for receiving sequentially the cut sections of coil as the coil advances axially beyond the cutting station, said receiving device being dimensioned to encompass and to be spaced around the coil sections, and so being constructed as to open and thereby release the coil sections therefrom; means for supplying fluid to the receiving device; and means for effecting opening of the receiving device.

32. Apparatus for damping vibrations in a coil wound around a rotating mandrel, in which a mandrel is rotating about an axis and a wire is wound around the rotating mandrel so as to form a rotating coil wound thereon and advancing along a path extending in the direction of the axis of rotation of the mandrel, wherein the improvement comprises:

elongate tube means for encompassing the coil and being dimensioned so as to be spaced around the coil, the tube means defining a confined, elongate flow path extending in the direction of the axis of rotation of the mandrel and along at least a part of the path of advancement of the coil, the tube means having an inlet and at least one outlet for fluid mutually spaced along the tube means and in fluid flow communication with one another through the flow path;

means for supplying damping fluid to the fluid inlet of the tube means, whereby the fluid can pass along the confined flow path and exit through the fluid outlet of the tube means;

a cutting station for cutting the wound coil into axial sections of predetermined length as the wound coil advances;

a receiving device for receiving sequentially the cut sections of coil as the coil advances axially beyond the cutting station, said receiving device being dimensioned to encompass and to be spaced around the coil sections, and being so constructed as to open and thereby release the coil sections therefrom;

means for supplying fluid to the receiving device; and means for effecting opening of the receiving device.

33. Apparatus as claimed in claim 32, wherein the tube means is arranged such that the one outlet of the tube means is located in the region of initial winding of the wire on the mandrel.

34. Apparatus as claimed in claim 32, wherein the tube means has two opposite ends adjacent to each of which a fluid outlet is provided, whereby fluid can pass from the fluid inlet of the tube means along the confined flow path toward the opposite ends, and can exit the tube means through both outlets.

35. Apparatus according to claim 32, wherein the fluid inlet is positioned substantially between the opposite ends of the tube means.

36. Apparatus according to claim 32, wherein the tube means is made of a plastics material.

37. Apparatus according to claim 32, wherein the tube means is made of a material selected from the group consisting of transparent and translucent materials.

* * * * *

UNITED STATES PATENT AND TRADEMARK OFFICE

CERTIFICATE OF CORRECTION

PATENT NO. : 5,277,046

DATED : January 11, 1994

INVENTOR(S) : Paybarah et al

It is certified that error appears in the above-identified patent and that said Letters Patent is hereby corrected as shown below:

Claim 1, column 4, line 17 delete the word "flow" and substitute therefor --fluid--.

Claim 4, column 4, line 30 delete the word "a" and substitute therefor --the--.

Claim 11, column 5, line 11 delete "as claimed in" and substitute therefor --according to--.

Claim 34, column 8, line 28 delete "as claimed in" and substitute therefor --according to--.

Signed and Sealed this

Seventeenth Day of May, 1994

Bruce Lehman

*Attest:*

BRUCE LEHMAN

*Attesting Officer*

*Commissioner of Patents and Trademarks*